US010718083B2

(12) United States Patent
Kim

(10) Patent No.: US 10,718,083 B2
(45) Date of Patent: Jul. 21, 2020

(54) METHOD FOR CONTROLLING LAUNDRY PROCESSING APPARATUS

(71) Applicant: LG Electronics Inc., Seoul (KR)

(72) Inventor: Taewan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/091,025

(22) PCT Filed: Feb. 16, 2017

(86) PCT No.: PCT/KR2017/001731
§ 371 (c)(1),
(2) Date: Oct. 3, 2018

(87) PCT Pub. No.: WO2017/175969
PCT Pub. Date: Oct. 12, 2017

(65) Prior Publication Data

US 2019/0112753 A1 Apr. 18, 2019

(30) Foreign Application Priority Data

Apr. 5, 2016 (KR) ..... 10-2016-0041576

(51) Int. Cl.
*D06F 58/30* (2020.01)
*D06F 58/04* (2006.01)
(Continued)

(52) U.S. Cl.
CPC ..... *D06F 58/30* (2020.02); *D06F 58/04* (2013.01); *D06F 58/203* (2013.01); *D06F 58/38* (2020.02);
(Continued)

(58) Field of Classification Search
CPC ..... D06F 58/28; D06F 58/04; D06F 58/203; D06F 2058/2816; D06F 2058/2835;
(Continued)

(56) References Cited

U.S. PATENT DOCUMENTS 2,961,776 A * 11/1960 Hughes ..... D06F 58/28 34/607
3,309,783 A * 3/1967 Worst ..... D06F 58/28 34/553
(Continued)

FOREIGN PATENT DOCUMENTS

DE 102010000432 A1 * 11/2010 ..... D06F 58/04
EP 3333300 B1 * 5/2019 ..... D06F 33/02
(Continued)

OTHER PUBLICATIONS

International Search Report in International Application no. PCT/KR2017/001731, dated Jun. 20 2017, 4 pages.

*Primary Examiner* — Stephen M Gravini
(74) *Attorney, Agent, or Firm* — Fish & Richardson P.C.

(57) ABSTRACT

A method for controlling a laundry processing apparatus, according to an embodiment of the present invention, is a method for controlling a clothes processing apparatus, comprising the steps of: inputting a "drying" start command; forwardly rotating a drying drum and a drying fan; supplying hot air into the drying drum; operating a timer so as to calculate drying time; and operating a dryness sensor so as to detect the dryness of laundry, wherein a controller determines that the laundry is tangled, if a dryness sensing value (K) detected by the dryness sensor is greater than or equal to a first set value (k1) before a first set time (T1) elapses after "drying" starts, and the controller performs a primary laundry untangling process for reversely rotating the drying drum for a second set time (T2).

13 Claims, 7 Drawing Sheets

(51) Int. Cl.

| | |
|---|---|
| ***D06F 58/20*** | (2006.01) |
| ***D06F 58/38*** | (2020.01) |
| ***D06F 58/50*** | (2020.01) |
| ***D06F 103/00*** | (2020.01) |
| ***D06F 103/02*** | (2020.01) |
| ***D06F 103/10*** | (2020.01) |
| ***D06F 103/34*** | (2020.01) |
| ***D06F 103/44*** | (2020.01) |
| ***D06F 105/46*** | (2020.01) |

(52) U.S. Cl.
CPC ..... *D06F 58/50* (2020.02); *D06F 2103/00* (2020.02); *D06F 2103/02* (2020.02); *D06F 2103/10* (2020.02); *D06F 2103/34* (2020.02); *D06F 2103/44* (2020.02); *D06F 2105/46* (2020.02)

(58) Field of Classification Search
CPC ..... D06F 2058/2858; D06F 2058/2861; D06F 2058/2877
USPC ..... 34/493
See application file for complete search history.

(56) References Cited

U.S. PATENT DOCUMENTS

| | | | | | |
|---|---|---|---|---|---|
| 5,555,645 | A * | 9/1996 | Joslin | D06F 58/28 | 34/427 |
| 5,651,194 | A * | 7/1997 | Hayashi | D06F 58/28 | 34/550 |
| 7,325,330 | B2 * | 2/2008 | Kim | D06F 33/02 | 34/407 |
| 8,104,191 | B2 * | 1/2012 | Ricklefs | D06F 58/203 | 34/474 |
| 8,276,293 | B2 * | 10/2012 | Ricklefs | D06F 58/203 | 34/595 |
| 9,133,575 | B2 * | 9/2015 | Hong | D06F 25/00 | |
| 9,359,713 | B2 * | 6/2016 | Kang | D06F 25/00 | |
| 10,094,065 | B2 * | 10/2018 | Kim | D06F 58/28 | |
| 10,113,263 | B2 * | 10/2018 | Ashrafzadeh | D06F 58/04 | |
| 10,301,765 | B2 * | 5/2019 | Lee | D06F 58/28 | |
| 2019/0112753 | A1 * | 4/2019 | Kim | D06F 58/203 | |

FOREIGN PATENT DOCUMENTS

| | | | | |
|---|---|---|---|---|
| JP | 07185196 | | 7/1995 | |
| JP | 10235092 | | 9/1998 | |
| JP | 2013128632 | | 7/2013 | |
| KR | 100146928 | | 10/1998 | |
| KR | 1020120005867 | | 1/2012 | |
| WO | WO-2013000904 | A1 * | 1/2013 | D06F 58/28 |
| WO | WO-2017175969 | A1 * | 10/2017 | D06F 58/203 |

* cited by examiner

METHOD FOR CONTROLLING LAUNDRY PROCESSING APPARATUS

CROSS-REFERENCE TO RELATED APPLICATIONS

This application is a National Stage application under 35 U.S.C. § 371 of International Application No. PCT/KR2017/001731, filed on Feb. 16, 2017, which claims the benefit of Korean Application No. 10-2016-0041576, filed on Apr. 5, 2016. The disclosures of the prior applications are incorporated by reference in their entirety.

TECHNICAL FIELD

The present invention relates to a control method of a laundry processing apparatus including a drying machine

BACKGROUND ART

A drum-type drying machine supplies high-temperature hot air into a drum while rotating in one direction to dry laundry. When laundry, such as a bed sheet, having a wider area and a lighter weight is contained in the drum, a laundry tangling frequently occurs in which the laundry having a wider area surrounds laundry having a smaller area in a drying process, which is called a Santa Bag. When the Santa Bag occurs, a dryness sensor mounted in the drum may not exactly sense the dryness of the laundry.

In other words, even though the laundry contained in the drum is not sufficiently dried, only the dryness of the laundry surrounding the laundry having the smaller volume may be sensed. In this case, even though the laundry is not sufficiently dried, a controller of the drying machine may erroneously determine that a drying completion time almost comes.

A conventional laundry processing apparatus disclosed in Korea Unexamined Patent Publication No. 2010-0031865 controls the drying drum to periodically and alternately perform forward rotation and reverse rotation to prevent or minimize the laundry tangling.

As described above, if the drying drum periodically repeats the forward rotation and the reverse rotation in the drying process, the laundry tangling may not be prevented from occurring significantly frequently under a specific condition. In addition, once the laundry tangling occurs, the laundry tangling may not be improved for a reverse rotation time according to the related art.

In addition, if the drying drum frequently rotates reversely, an amount of wind introduced into the drying drum is reduced, so the drying efficiency may be degraded. For example, in the case of a drying machine including a drying drum, which is coupled to a one-side rotational shaft of a driving motor through a pulley and a belt, and a drying fan mounted on an opposite-side rotational shaft of the driving motor, when the driving motor rotates reversely, the drying fan may move reversely to prevent hot air from being introduced into the drying drum or an amount of hot air to be introduced may be reduced.

DISCLOSURE

Technical Problem

The present invention has been made to solve the above-mentioned problems occurring in the prior art.

Technical Solution

In order to accomplish the objects, according to one aspect of the present invention, there is provided a method for controlling a laundry processing apparatus, the method includes inputting a command for starting drying, forwardly-rotating a drying drum and a drying fan, supplying hot air into the drying drum, integrating a drying time by operating a timer, and sensing a dryness of the laundry dryness of laundry in the drying drum by operating a dryness sensor. A controller determines that the laundry is tangled, when a dryness sensing value K sensed by the dryness sensor is equal to or greater than a first set value k1 before a first set time T1 elapses after the drying is started. The controller performs a primary laundry untangling process of reversely rotating the drying drum for a second set time T2.

Advantageous Effects

The control method of the laundry processing apparatus in an embodiment of the present invention has the following effects.

First, the drying drum rotates reversely only when the laundry is tangled, instead of periodically rotating forwardly and reversely to dry the laundry, thereby minimizing the degradation of the drying efficiency.

Second, the process of sensing that the laundry is tangled is performed twice. Accordingly, the reverse rotation of the drying drum is performed to untangle the laundry at the initial stage that the laundry is tangled. Therefore, the drying efficiency may be prevented from being degraded as the laundry is tangled, and the damage to cloth may be minimized.

Third, the drying drum rotates reversely only when the laundry is tangled, instead of periodically rotating forwardly and reversely to dry the laundry. Accordingly, power consumption for the reverse rotation of the driving motor to rotate the drying drum may be minimized.

Fourth, when compared with the conventional technology, since the number of times that the drying drum reversely rotates is more reduced, it is possible to more reduce a time required to switch the rotational direction of the drying drum. Accordingly, the drying time may be reduced.

Fifth, the additional sensing unit is not required to sense that the laundry is tangled. Accordingly, since the dryness sensor mounted in the drying drum is used, additional costs is not required to realize the control method of the laundry processing apparatus according to an embodiment of the present invention.

BEST MODE

Mode for Invention

Hereinafter a control method of a laundry processing apparatus according to an embodiment of the present invention will be described in detail.

Figure 1:
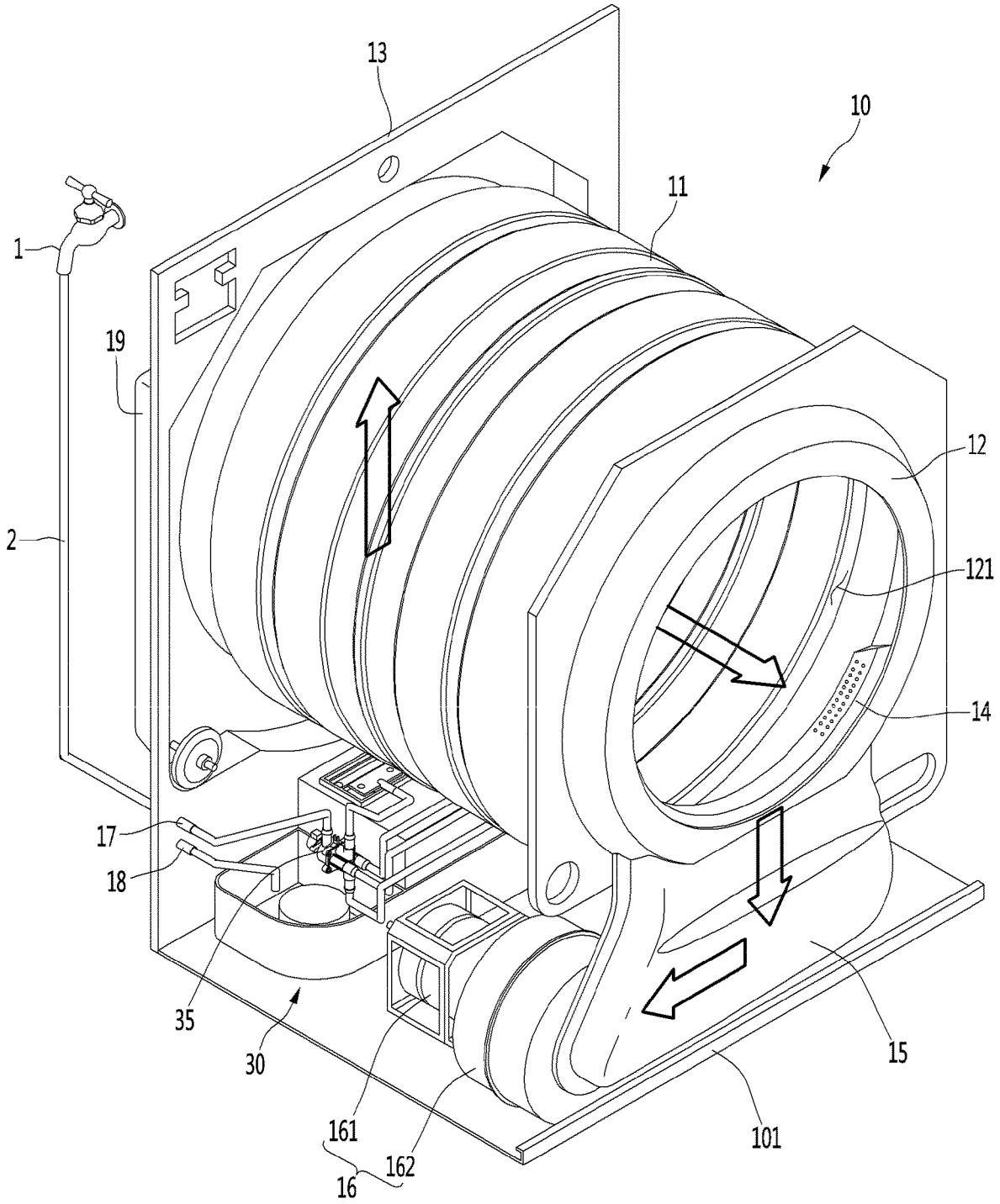
FIG. 1 is a perspective view illustrating a laundry processing apparatus for realizing a control method according to an embodiment of the present invention.
Figure 2:
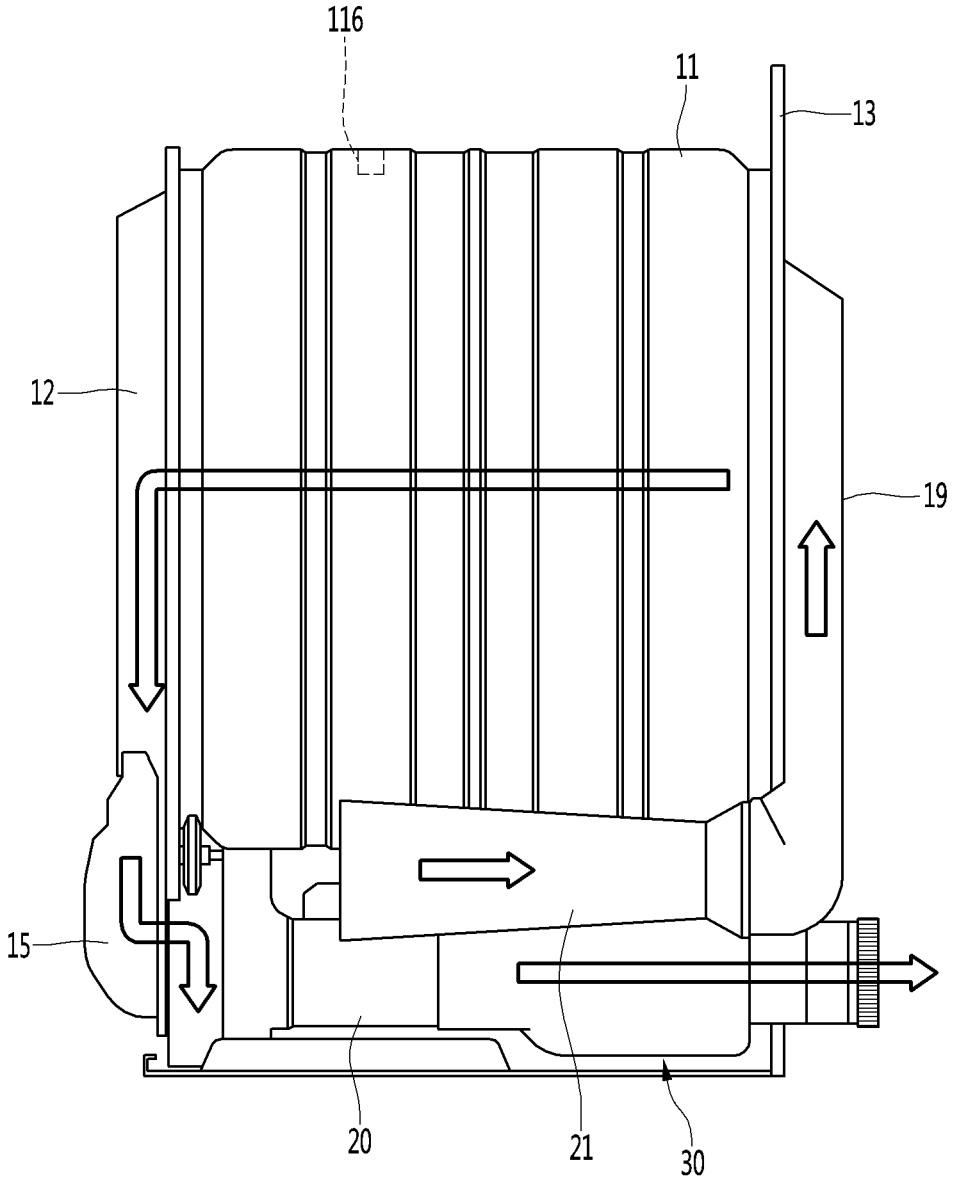
FIG. 2 is a side view of the laundry processing apparatus.

FIG. 1 is a perspective view illustrating a laundry processing apparatus for realizing a control method according to an embodiment of the present invention, and FIG. 2 is a side view of the laundry processing apparatus.

Hereinafter, a heat-pump type clothes drying machine will be described by way of the laundry processing apparatus to which the control method according to an embodiment of the present invention is applied. The control method according to an embodiment of the present invention is applicable to all types of dying machine employing a drying drum, as well as the heat-type clothes drying machine.

Referring to FIGS. 1 and 2, the laundry processing apparatus, that is, a clothes drying machine 10 to which the control method according to an embodiment of the present invention is applicable, may include a drying drum 11 into which a target to be dried is introduced, a dryness sensor 116 mounted on an inner circumference of the drying drum 11, a front cabinet 12 to support a front portion of the drying drum 11, a blocking member 14 mounted on the floor of the front cabinet 12, a rear cabinet 13 to support the rear portion of the drying drum 11, and a lint filter device 30.

In detail, the dryness sensor 116 may include an electrode sensor to sense the dryness of laundry by using an electric potential value generated as the dryness sensor 116 makes contact with the laundry rotating inside the drying drum 11. In addition, the dryness sensor 116 may be mounted on one side of the inner circumference of the drying drum 11 allowing the contact with the laundry. In other words, the dryness sensor 116 may be mounted on any one of a front end portion, a rear end portion, and an inner circumference of a body part connecting the front end portion and the rear end portion.

In addition, the clothes dying machine 10 may further include an intake duct 21 to introduce air to be supplied to the drying drum 11, a rear duct 19 to allow the intake duct 21 to communicate with an air introduction hole formed in the drying drum 11, a guide duct 15 communicating with the bottom surface of the front cabinet 12 to guide air discharged from the drying drum 11, an air blowing device 16 connected to an exit end of the guide duct 15, and an exhaust duct 20 communicating with the exit port of the air blowing device 16. The lint filter cleaning device 30 is mounted on any point of the exhaust duct 20 to filter a nap from air flowing along the exhaust duct 20 when the air passes through a lint filter assembly provided in the lint filter cleaning device 30.

Meanwhile, a middle cabinet (not illustrated) is disposed between the front cabinet 12 and the rear cabinet 13 to cover and protect the drying drum 11 and various parts provided at a lower portion of the drying drum 11. The middle cabinet defines both lateral sides and a top surface of the clothes drying machine 10. A base plate 101 is provided on a bottom surface of the middle cabinet to define a floor of the clothes drying machine 10, and the parts may be mounted on the base plate 101.

In addition, the blocking member 14 is provided to prevent a hard foreign matter, such as a coin and a ball point pen, which has a large volume and is contained in laundry to be dried, from being introduced into the guide duct 15 in the drying process. Even if a foreign matter, such as the nap, is introduced into the guide duct 15, the foreign matter is filtered by the lint filter assembly (to be described) mounted in the lint filter cleaning device 30. Other hard foreign matters, which have a larger volume, are blocked by the blocking member 14 such that the foreign matters stay in the drying drum 11. If foreign matters other than the nap are introduced into the guide duct 15, since the air blowing device 16 may be damaged or may cause noise inside the exhaust duct 20, the foreign matter may be prevented from deviating from the drying drum 11 by the blocking member 14. In addition, the blocking member 14 may be detachably coupled to the front cabinet 12.

In addition, a cleaning water feeding tube 17 and a cleaning water discharge tube 18 are connected to the lint filter cleaning device 30. An inlet end of the cleaning water feeding tube 17 may be provided in the rear cabinet 13 to communicate with a water feeding tube 2 connected to an external water feeding source 1. In addition, an outlet end of the cleaning water feeding tube 17 communicates with an inlet port of a control valve 35 of the lint filter cleaning device 30. In addition, an inlet end of the cleaning water discharge tube 18 is connected to a discharge pump assembly (not illustrated) of the lint filter cleaning device 30.

The air blowing device 16 includes a fan motor 161 and a blowing fan 162 connected to the rotational shaft of the fan motor 161. The blowing fan 162 is provided at an exit end of the guide duct 15 to guide air, which is guided to the guide duct 15 through the drying drum 11, to the discharge duct 20.

According to the present embodiment, although the driving motor (not illustrated) to rotate the drying drum 11 is provided in a structure separate from the fan motor 161, there may be provided a structure in which one driving motor simultaneously rotates the drying drum and the blowing fan 162.

Meanwhile, in the case of a discharge-type drying machine, a gas combustion device is provided at an entrance of the intake duct 21 to heat air introduced into the intake duct 21 to a higher temperature. In addition, in the case of an electric drying machine, an electric heater is provided inside the rear duct 19 to heat the air introduced through the intake duct 21 to the higher temperature before introduced into the drying drum 11.

Regarding the brief description of the drying process of the clothes drying machine 10 having the above configuration, laundry to be dried is introduced into the drying drum 11 through an introduction hole 121 provided in the front cabinet 12. In addition, if a command for starting drying is input, the air blowing device 16 operates and the drying drum 11 rotates in one direction. In addition, the air introduced into the intake duct 21 is heated to the higher temperature by the gas combustion device or the electric heater. In addition, the air heated to the higher temperature is introduced into the drying drum 11 through the rear surface of the drying drum 11 after flowing along the rear duct 19. In addition, the higher-temperature dried air introduced into the drying drum 11 is changed to a higher-temperature humid air while drying the laundry. In addition, the higher-temperature humid air is guided to the guide duct 15 through the blocking member 14 while containing a nap produced from the laundry to be dried. In addition, the higher-temperature humid air guided to the guide duct 15 is guided to the exhaust duct 20 by the air blowing device 16. The higher-temperature humid air guided to the exhaust duct 20 passes through the lint filter cleaning device 30 and thus a nap is filtered out by the lint filter assembly. In addition, the lint filter cleaning device 30 operates, and thus the nap is removed from the lint filter assembly and discharged out together with cleaning water by a discharge pump assembly.

Meanwhile, the lint filter cleaning device 30 may be provided even in a circulation-type drying machine employing a heat pump. In detail, in the circulation-type drying machine using the heat pump, a heat pump cycle is mounted in the cabinet such that the higher-temperature humid air passing through the drying drum 11 passes through the evaporator of the heat pump cycle. In addition, the air, which is changed to lower-temperature dried air while passing through the evaporator, passes through a condenser of the heat pump cycle to be changed to high-temperature dried air. The higher-temperature dried air obtained through the condenser passes through the rear surface of the drying drum 11 along the air duct to be introduced into the drying drum 11. In addition, the lint filter cleaning device 30 is mounted at any point of a humid air passage connected with the evaporator. Accordingly, the higher-temperature humid air obtained while passing through the drying drum 11 passes through the lint filter cleaning device 30 before passing through the evaporator and thus foreign matters including a nap is filtered out by the lint filter assembly. The steam contained in the wet steam obtained while passing through the drying drum 11 is condensed while passing through the evaporator. In addition, the water generated by the condensation may be guided to a drain pump assembly. In other words, not only water provided to clean the lint filter assembly, but also water generated by condensation through the evaporator are guided to the drain pump assembly.

In addition, fine foreign matters may be contained in air which is output from the lint filter assembly and may stick to the surface of the evaporator. In other words, fine naps may stick to the pipe and the cooling fin of the evaporator. To remove these, an additional nozzle for cleaning the evaporator may be used, such that the naps may be removed from the surface of the evaporator. In addition, even water used to clean the evaporator may be guided to the drain pump assembly of the lint filter assembly.

Figure 3:
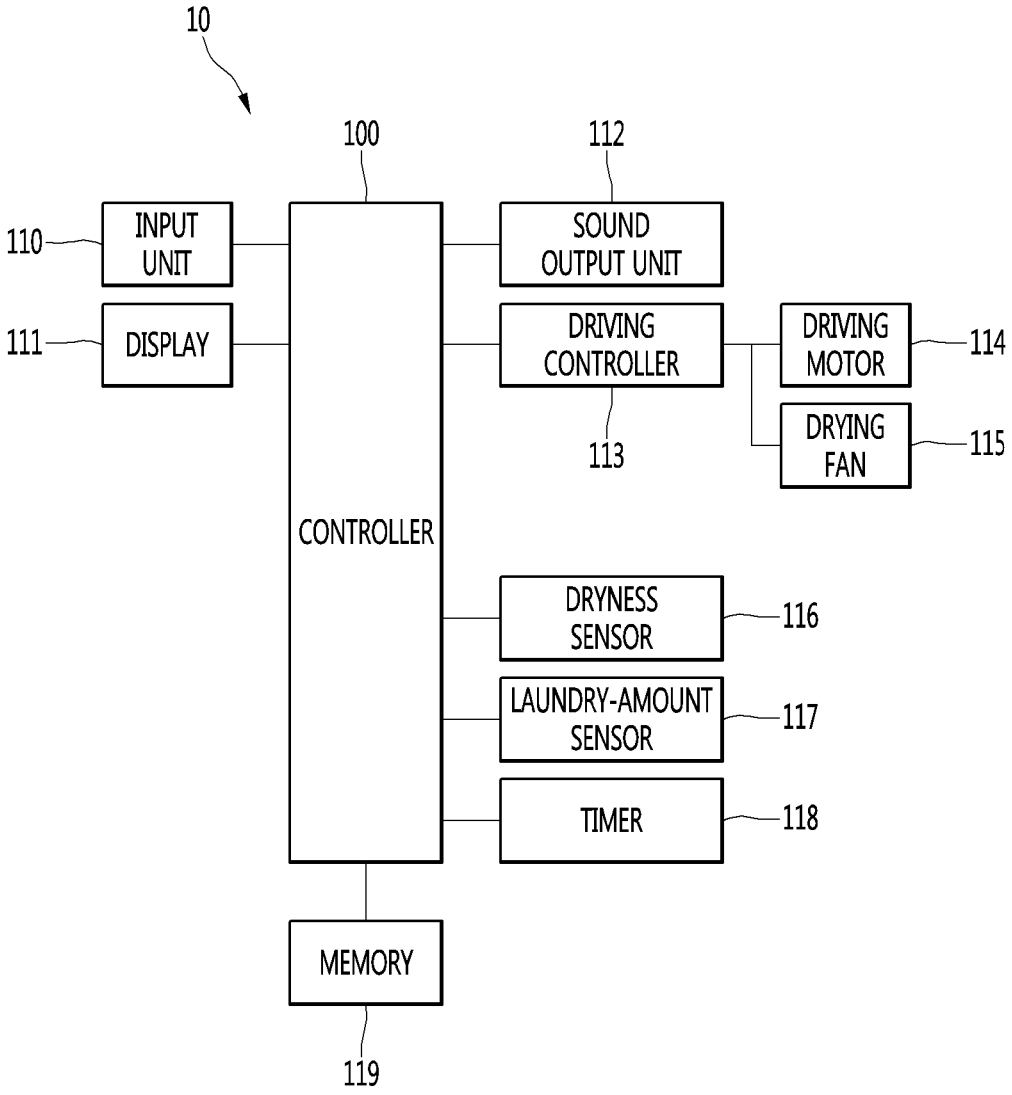
FIG. 3 is a control block schematically illustrating the configuration for controlling a clothes drying machine, which is included in the laundry processing apparatus according to an embodiment of the present invention.

FIG. 3 is a control block schematically illustrating the configuration for controlling clothes drying machine, which is included in the laundry processing apparatus according to an embodiment of the present invention.

Referring to FIG. 3, the laundry processing apparatus, that is, the clothes drying machine 10, which performs the control method according to an embodiment of the present invention, may include a controller 100, an input unit 110, a display 111, a sound output unit 112, a driving controller 113, a dryness sensor 116, a laundry-amount sensor 117, a timer 118, and a memory 119.

The clothes drying machine 10 may include a driving motor 114 and a drying fan 162, operations of which are controlled by the driving controller 113. The driving motor 114 may include a motor to rotate the drying drum 11 and a fan motor 161 to rotate the drying fan 162.

In detail, the input unit 110 may include a plurality of pressing buttons, a plurality of touch buttons, or a rotary-type button, such as a jog shuttle, to input a drying condition and a command for starting drying.

In addition, the display 111 may include a display unit to display a driving condition or a drying state.

The sound output unit 112 includes a speaker and outputs a sound for notifying a user of "drying started" and "drying ended" or a beep sound for notifying the user of an error occurring during drying.

The driving controller 113 may include a driver integrated circuit (IC) for controlling the operation of the driving motor 114.

The laundry-amount sensor 117, which serves as a weight sensor to sense the weight of the laundry introduced into the drying drum 11, may include a pressure sensor.

Hereinafter, a control method of the laundry processing apparatus to sense a laundry tangling and to untangle the laundry according to an embodiment of the present invention will be described in detail with reference to a flowchart.

Figure 4:
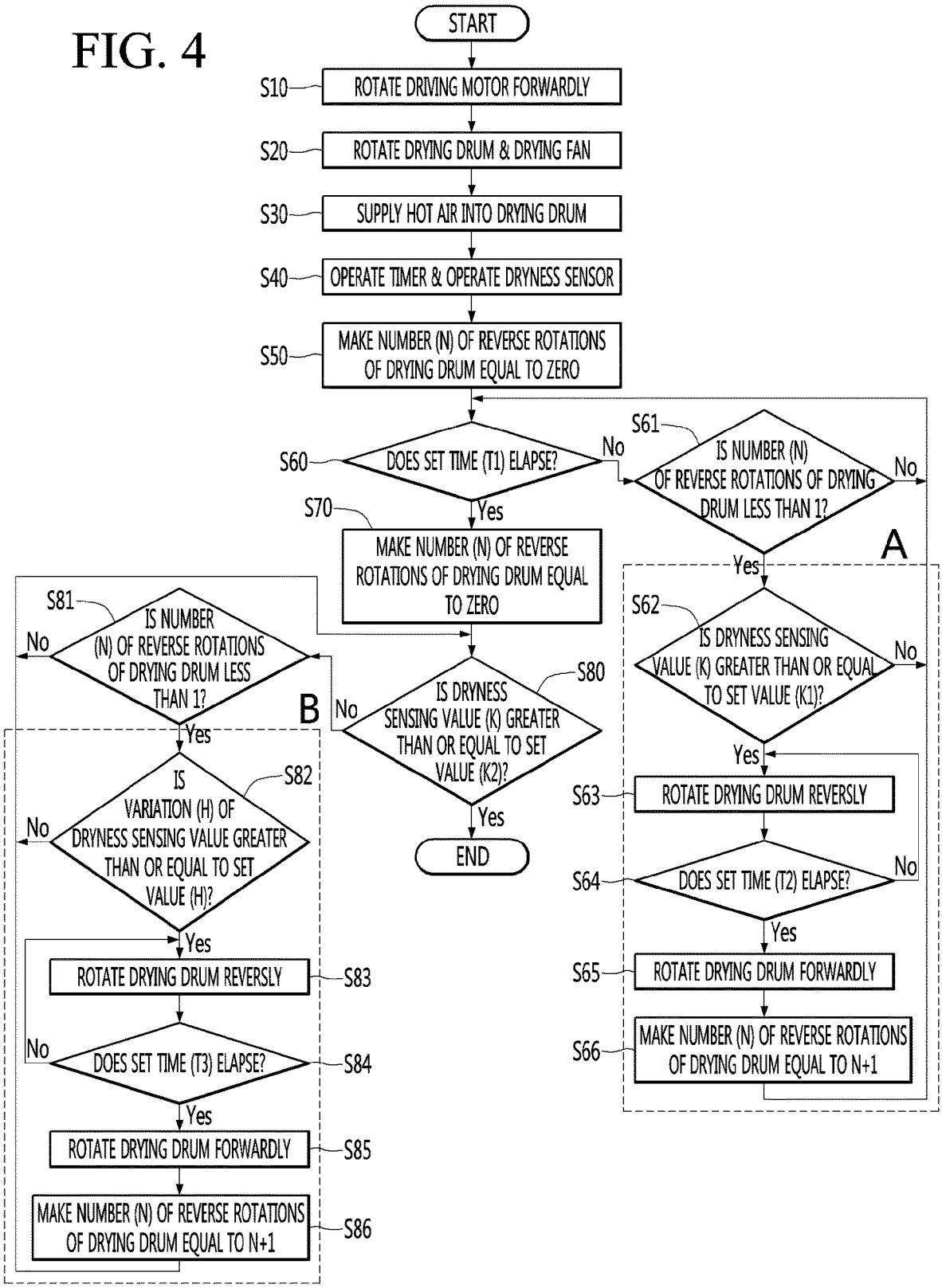
FIG. 4 is a flowchart illustrating a control method of a laundry processing apparatus according to an embodiment of the present invention.

FIG. 4 is a flowchart illustrating a control method of the laundry processing apparatus according to an embodiment of the present invention.

Referring to FIG. 4, the control method of the laundry processing apparatus according to an embodiment of the present invention is characterized in that the sensing of the laundry tangling and the untangling of the tangled laundry are performed twice. In other words, a primary sensing procedure A is performed to sense whether the laundry tangling occurs within a preset time after starting drying and a secondary sensing procedure B is performed to sense whether the laundry tangling occurs between a time point that the primary sensing procedure A is finished and a time point that the drying is completed.

In addition, each of the primarily sensing procedure A and the secondary sensing procedure B is configured to be performed only one time. When the process of untangle the laundry is allowed to be repeatedly performed under every situation of satisfying the untangling condition within the set time, the drying time may be delayed or the drying efficiency may be degraded.

Firstly, laundry, which has been completed a spin-drying process but not completely dried, is introduced into the drying drum 11. Then, if a command for starting the drying is input, the driving motor 114 is powered to rotate forwardly in a first direction (S10). The drying drum 11 and the drying fan 162 rotate as the driving motor 114 rotates (S20) and hot air is supplied into the drying drum 11 (S30). Then, a timer operates to measure the drying time and the dryness sensor operates to sense the dryness of the laundry (S40). In addition, the controller 100 sets the number of reverse rotations of the drying drum 11 to zero (S50). If the command for starting the drying is input, a series of process from a process of allowing driving motor to rotate forwardly to a process of setting the number of the reverse rotations of the drying drum to zero may be simultaneously performed.

It is determined whether a first set time T1 elapses from a time point that the drying is started (S60), and determined whether a first tangled-laundry sensing condition occurs before the first set time T1 elapses.

In this case, when a laundry tangling occurs, the drying drum rotates reversely for a set time, such that the laundry is untangled. In addition, it is firstly determined whether a laundry untangling process of allowing the drying drum to rotate reversely has been previously performed before the tangled-laundry sensing is performed, such that the tangled-laundry sensing is performed only one time. In other words, the controller determines whether the number of reverse rotations of the drying drum is one time or more (S61). In this case, the number of the reverse rotations of the drying drum refers to the number of times that the rotation condition of the drying drum is changed from the forward rotation to the reverse rotation and does not refer to the reverse revolutions per minute (RPM) of the drying drum. In other words, that the number of reverse rotations of the drying drum is 1 means that the rotation condition of the drying drum is changed from the forward rotation to the reverse rotation one time and, in detail, means that the laundry untangling process is performed one time as the laundry tangling is sensed.

If the number N of reverse rotations of the drying drum is 1 or more, the process of sensing the laundry tangling is not performed any more until the first set time T1 elapses. In other words, the drying drum 11 is maintained in the forward rotation state until the first set time T1 elapses after each of the process of sensing the laundry tangling and the process of untangling the laundry are performed one time.

In contrast, if the number of reverse rotations of the drying drum is zero, that is, if the process of untangling the laundry has never been performed, the controller receives the dryness value sensed by the dryness sensor 116. In addition, the controller 100 determines whether the dryness sensing value K, which is received, is equal to or greater than a set value k1 (S62). The first set time T1 may be 1,500 seconds (25 minutes). In this case, the process of determining whether the dryness sensing value K is equal to or greater than the set value K1 may be called a primary tangled-laundry sensing step.

In addition, the dryness sensing value is a value obtained by converting the value of the electrode voltage V, which is generated when the dryness sensor 116 makes contact with the laundry, into a non-dimensional value. As fabric has less remaining moisture contents (RMC) or final moisture contents (FMC), the dryness sensor 116 senses a higher electrode voltage. In addition, the dryness sensing value represents higher value corresponding to the value of the electrode voltage. Accordingly, as illustrated in following table, as the drying process approaches the completion stage, the dryness sensing value is gradually increased.

TABLE 1

| Dryness sensing value (K) | Electrode voltage (V) | RMC (%) |
|---|---|---|
| 57 | 1.12 | 60 |
| 75 | 1.47 | 53.5 |
| 100 | 1.96 | 44.5 |
| 150 | 2.94 | 26.4 |
| 210 | 4.12 | 4.7 |
| 223 | 4.37 | 0 |

In addition, the set value k1 may be in the range of 80 to 110, and more specifically, may be in the range of 90-100. In more specifically, the set value k1 may be 90.

Accordingly, if the dryness sensing value is sensed as 90 or more within the first set time T1 (25 minutes) after starting the drying, it may be determined that the laundry tangling occurs. In detail, in a state of laundry tangling, so called in the Santa Bag state that laundry such as a bed sheet surrounds another laundry, the dryness sensor 116 makes contact with the bed sheet to sense the dryness of the bed sheet. Since thin cloth, such as a bed sheet, is more rapidly dried, the laundry such as the bed sheet may be sensed with a higher value. However, other laundries surrounded by the bed sheet may not be dried at all. Accordingly, when the dryness is sensed as a higher value before the first set time elapses, the controller may determine that the laundry tangling.

Meanwhile, if it is determined that the dryness sensing value K is equal to or more than the set value k1 in the primary tangled-laundry sensing step (S62), a primary laundry untangling process is performed. In other words, the drying drum 11 rotates reversely for a second set time T2 and rotates forwardly again after the second set time T2 elapses (S63-S65). In addition, the number N of reverse rotations of the drying drum becomes "1" (S66).

Meanwhile, after the first set time T1 elapses, the number of the reverse rotations of the drying drum is reset to zero (S70). If the laundry untangling process is performed within the first set time T1, the number N of the reverse rotations of the drying drum is reset to zero from 1. If the laundry untangling process is not performed within the first set time T1, the number N of the reverse rotations of the drying drum is maintained to zero.

In addition, the controller determines whether the drying is completed, based on the dryness value sensed by the dryness sensor 116 after the first set time T1 elapses (S80).

In detail, the controller determines whether the dryness value sensed by the dryness sensor 116 is equal to or greater than the second set value k2 (S80). The second set value k2 may be a value of 220 or more used for determining whether the drying is completed. As illustrated table 1, the dryness sensing value of 220 or more means that the RMC of the laundry approximates zero. Accordingly, the second set value k2 may be set to any one of values greater than 220.

If it is determined that the dryness sensing value obtained by converting an electrode voltage, which is sensed by the dryness sensor 116, into a non-dimensional value is greater than or equal to the second set value k2, the drying process is terminated. In other words, the operations of the driving motor, the drying drum, and the drying fan are stopped and the supply of the hot air is stopped.

Meanwhile, if it is determined that the dryness sensing value K1 is less than the second set value k2, a secondary tangled-laundry sensing procedure is performed.

In detail, it is determined whether the number N of reverse rotations of the drying drum is equal to or greater than 1, before the secondary tangled-laundry sensing process is performed (S81). This is to determine whether a secondary laundry untangling process of allowing the drying drum to rotate reversely has been performed after the first set time T1 that the primary tangled-laundry sensing process is performed. In other words, this is to perform each of the secondary tangled-laundry sensing process and the secondary laundry tangling process only one time.

In detail, when the number N of the reverse rotations of the drying drum is 1, the drying drum 11 is maintained in the forward rotation state until the dryness sensing value reaches the second set value k2 representing that the drying is completed, in the state that the secondary tangled-laundry sensing process is not performed.

Meanwhile, when the number N of the reverse rotations of the drying drum is less than 1, and when the secondary tangled-laundry sensing process has never been performed previously, the controller 100 receives the dryness sensing value from the dryness sensor 116. In addition, the variation H of the dryness sensing value is calculated by using the received dryness sensing value.

The variation H of the dryness sensing value refers to the variation of the dryness per unit time. For example, when the dryness sensing value is increased from 100 to 150 for 150 seconds, the variation H may refer to a set value h. The set value h may refer to a gradient of a dryness graph.

Accordingly, it is determined whether the variation H of the dryness sensing value is equal to or greater than the set value h (S82). That the variation H of the dryness sensing value is greater than the set value h refers to the rapid increase of the dryness value within a short period of time.

This may refer to that laundry having a wider area and a lighter weight surrounds another laundry.

In this case, the secondary laundry untangling process is performed to allow the drying drum 11 to rotate forwardly after rotating reversely for a third set time T3 (S83 to S85). In addition, if the secondary laundry untangling process is completed, the number N of reverse rotations of the drying drum 11 is increased to "1" (S86) and it returns to the step (S80) of determining whether the drying is completed.

In this case, the second and third set times T2 and T3 may be set to be identical. If the second and third set times T2 and T3 are set to be identical, the second and third set times T2 and T3 may be set to 120 seconds. However, the present invention is not limited thereto, and the second set time T2 and the third set time T3 may be set to be mutually different from each other.

As described above, the primary tangled-laundry sensing process is performed one time before the middle stage of the drying process and the secondary tangled-laundry sensing process is performed one time in the second half of the drying process, thereby preventing the problem caused when the forward rotation and the reverse rotation of the drying drum are periodically repeated.

Figure 5:
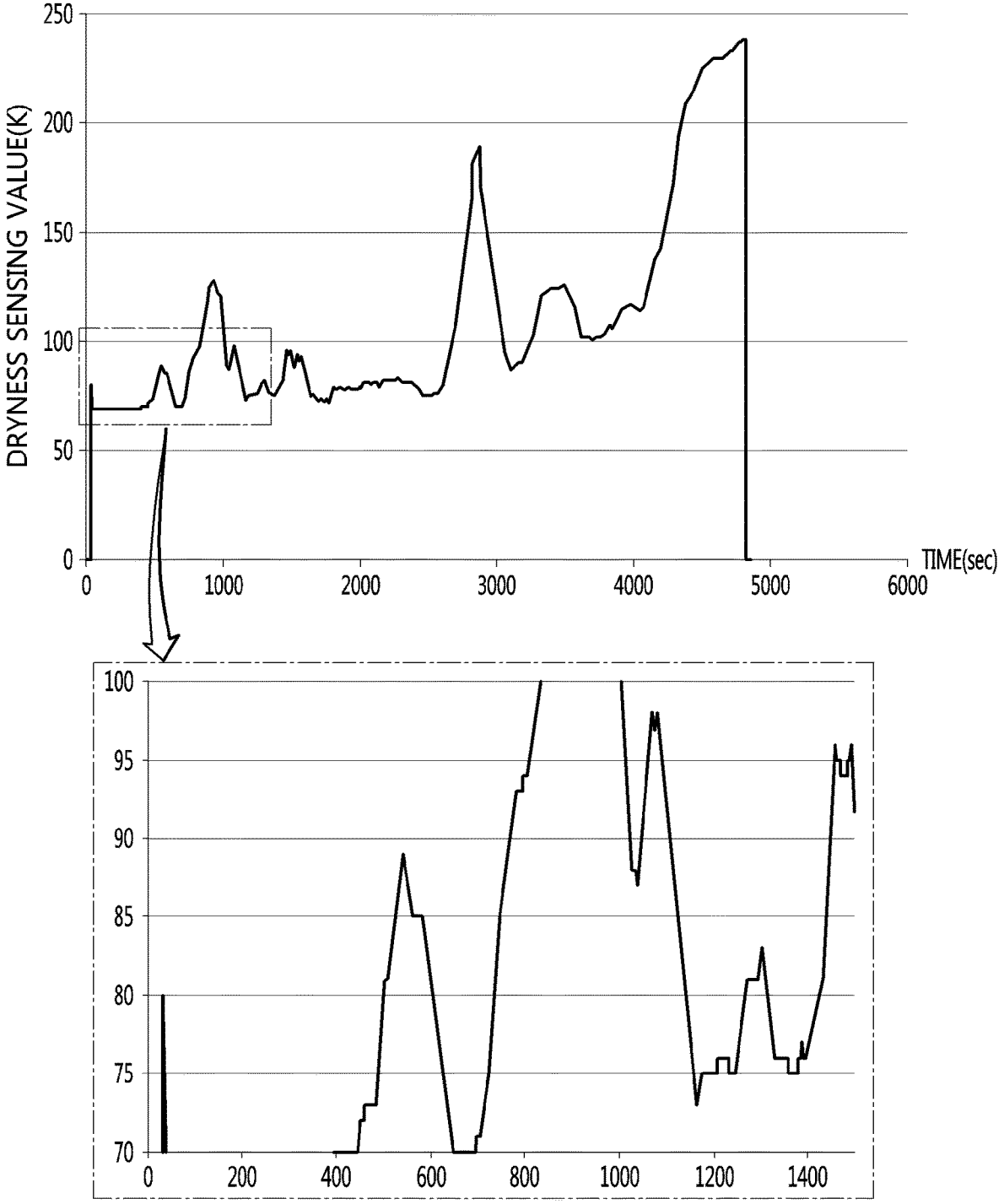
FIG. 5 is a graph illustrating the variation of the dryness values when a primarily laundry tangling process occurs at the initial stage of the drying process.

FIG. 5 is a graph illustrating the variation of the dryness value when a primary laundry tangling occurs at the initial stage of the drying process.

Referring to FIG. 5, the dryness sensing value may exceed 90 before 1,500 seconds elapse, in detail, at a time point between 800 seconds and 1000 seconds, after the drying process is started.

This shows that the laundry tangling occurs and thus the dryness sensing value is rapidly increased at the initial and intermediate stages of the drying process as described above. When the laundry tangling occurs, the primary laundry untangling process is performed.

Figure 6:
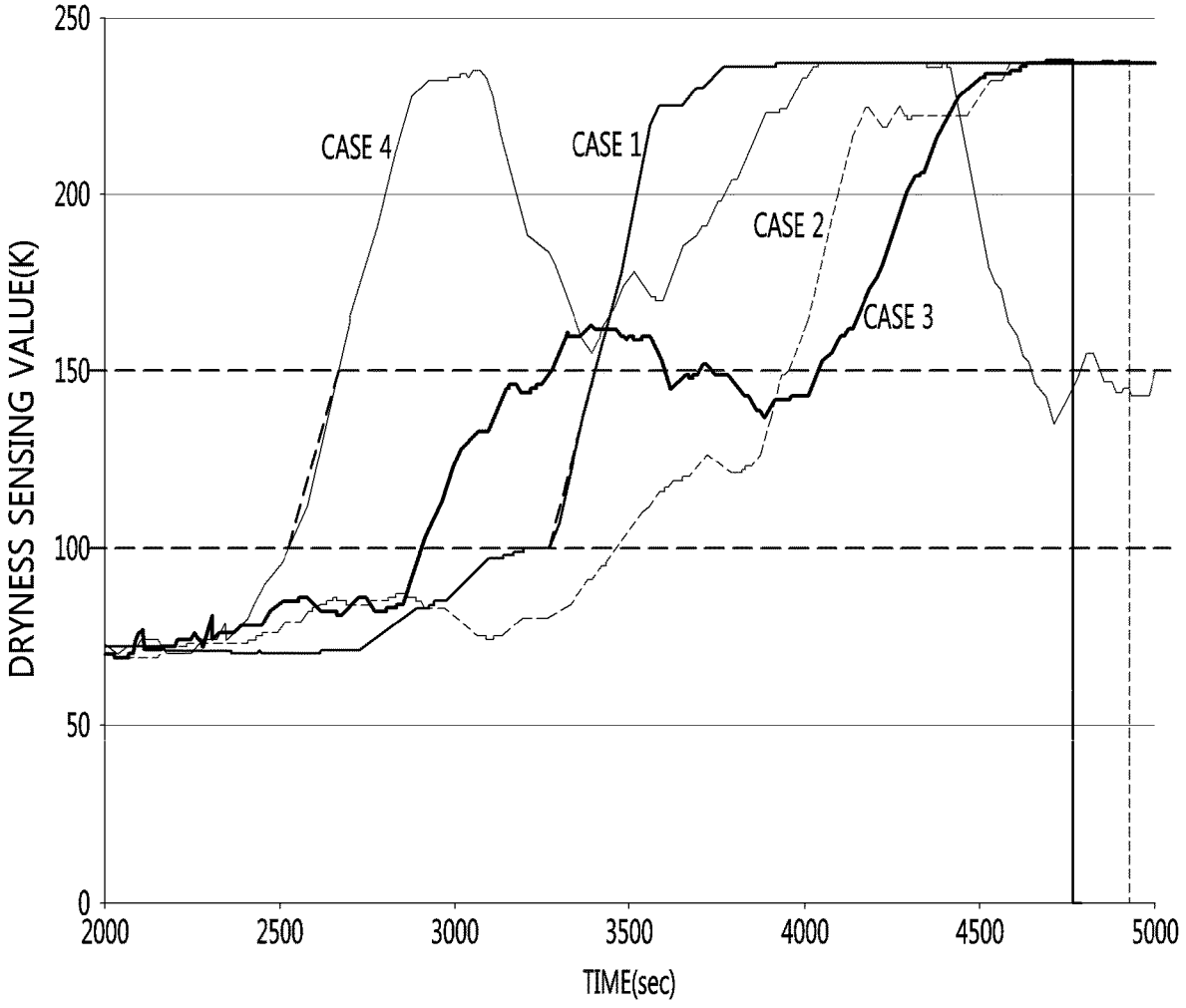
FIG. 6 is a graph illustrating the variations of the dryness values depending on cases when the secondary laundry tangling occurs and when the laundry is normally dried.

FIG. 6 is a graph illustrating the variations of the dryness depending on cases when the secondary laundry tangling occurs and when the laundry is normally dried.

Referring to FIG. 6, in graphs showing the dryness in case 1 and case 4 after the middle stage of the drying process, there occurs a section that the time taken to increase the dryness sensing value from 100 to 150 is within 150 seconds, that is, the section that the gradient of the dryness graph is sharply increased.

It may be interpreted that the laundry tangling occurs again after the middle stage of the drying process and thus the dryness sensing value is rapidly increased. In this case, the secondary laundry untangling process is performed.

In graphs of case 2 and case 3, it may be recognized that the variation (gradient) of the dryness sensing value is not rapidly increased in the section that the dryness value is increased from 100 to 150. In other words, it is interpreted that the time taken to increase the dryness sensing value from 100 to 150 is longer than 150 seconds, so the laundry untangling process is unnecessary.

Figure 7:
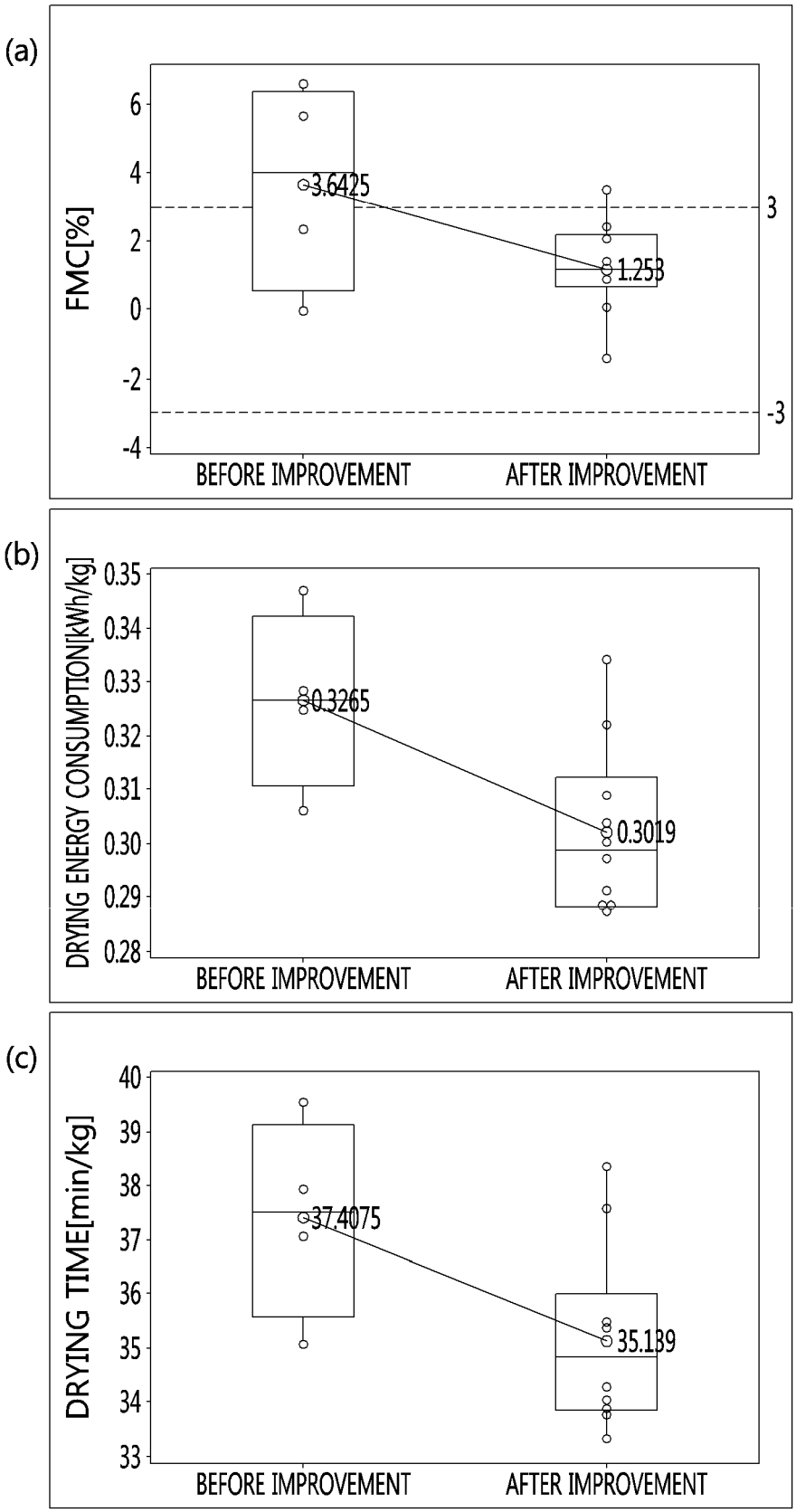
FIG. 7 illustrates graphs exhibiting effects of improving dryness when the control method is applied according to an embodiment of the present invention.

FIG. 7 illustrates graphs exhibiting effects of improving drying when the control method is applied according to an embodiment of the present invention.

FIG. 7A is a graph illustrating the FMC of the laundry before and after the FMC is improved, that is, the control method according to the embodiment of the present invention is applied.

For the comparison before and after the drying is improved, the drying condition is shown as in following table.

TABLE 2

| | Configuration | Weight (g) |
|---|---|---|
| cotton cup 2.5 kg | Sheet | 1070 |
| | Pillow | 157 |
| | Blue jeans for children | 342 |
| | Blue jeans for adult | 767 |
| | First towel | 77 |
| | Second towel | 77 |

As illustrated in FIG. 7A, when the control method according to an embodiment of the present invention is applied, the FMC is reduced as compared with the case that the control method is not applied.

FIG. 7B is a graph illustrating energy consumption before and after the energy consumption is improved. It can be recognized that when the control method according to an embodiment of the present invention is applied, the energy consumption is reduced as compared with the case that the control method is not applied.

FIG. 7C is a graph illustrating the drying time before and after the drying time is improved. It can be recognized that when the control method according to an embodiment of the present invention is applied, the drying time is more reduced as compared with when the control method is not applied.

The invention claimed is:

1. A method for controlling a laundry processing apparatus, the method comprising:

inputting a command for starting drying;

forwardly-rotating a drying drum and a drying fan;

supplying hot air into the drying drum;

integrating a drying time by operating a timer; and sensing a dryness of laundry in the drying drum by operating a dryness sensor, wherein a controller determines that the laundry is tangled, when a dryness sensing value (K) sensed by the dryness sensor is equal to or greater than a first set value (k1) before a first set time (T1) elapses after the drying is started, and wherein the controller performs a primary laundry untangling process of reversely rotating the drying drum for a second set time (T2).

2. The method of claim 1, wherein, when the second set time (T2) elapses, a rotational direction of the drying drum is changed such that the drying drum is controlled to be forwardly rotated.

3. The method of claim 2, wherein the primary laundry untangling process is performed only one time for the second set time (T2).

4. The method of claim 3, wherein whether the drying is completed is determined after the first set time (T1) elapses, and wherein a variation (H) of the dryness sensing value is calculated, by the controller, for a specific duration using the sensed dryness value receive from the dryness sensor before the drying is completed.

5. The method of claim 4, wherein the variation (H) of the dryness sensing value is a result obtained through {(second sensing value−first sensing value)/elapsed time}, and wherein the second sensing value is greater than the first sensing value.

6. The method of claim 5, wherein the controller determines that the laundry is tangled when it is determined that the variation (H) of the dryness sensing value is greater than a set value (h), and performs a secondary laundry untangling process of reversely rotating the drying drum for a third set time (T3).

7. The method of claim 6, wherein, when a time interval, which is taken to increase a dryness sensing value from the first sensing value to the second sensing value, is determined to be less than a set time (t), the controller determines that the laundry is tangled and performs the secondary laundry untangling process of reversely rotating the drying drum for the third set time (T3).

8. The method of claim 6, wherein, when the third set time (T3) elapses, the rotational direction of the drying drum is changed and the drying drum is controlled to be forwardly-rotated.

9. The method of claim 8, wherein the secondary laundry untangling process is performed only one time for the third set time (T3).

10. The method of claim 9, wherein the second set time (T2) is equal to the third set time (T3) or wherein one of the second set time (T2) and the third set time (T3) is shorter than the other of the second set time (T2) and the third set time (T3).

11. The method of claim 7, wherein, when the third set time (T3) elapses, the rotational direction of the drying drum is changed and the drying drum is controlled to be forwardly-rotated.

12. The method of claim 11, wherein the secondary laundry untangling process is performed only one time for the third set time (T3).

13. The method of claim 12, wherein the second set time (T2) is equal to the third set time (T3) or wherein one of the second set time (T2) and the third set time (T3) is shorter than the other of the second set time (T2) and the third set time (T3).

* * * * *